US009174714B2

(12) United States Patent
Kachkovsky

(10) Patent No.: US 9,174,714 B2
(45) Date of Patent: Nov. 3, 2015

(54) PORTABLE WATER CYCLE

(71) Applicant: Oliver B. Kachkovsky, Jacksonville, FL (US)

(72) Inventor: Oliver B. Kachkovsky, Jacksonville, FL (US)

(73) Assignee: ISEABIKE, INC., Jacksonville, FL (US)

( * ) Notice: Subject to any disclaimer, the term of this patent is extended or adjusted under 35 U.S.C. 154(b) by 0 days.

(21) Appl. No.: 14/306,554

(22) Filed: Jun. 17, 2014

(65) Prior Publication Data

US 2014/0370767 A1 Dec. 18, 2014

Related U.S. Application Data

(60) Provisional application No. 61/835,991, filed on Jun. 17, 2013.

(51) Int. Cl.

| | |
|---|---|
| ***B63B 35/36*** | (2006.01) |
| ***B63H 16/08*** | (2006.01) |
| ***B63B 1/12*** | (2006.01) |
| ***B63B 7/04*** | (2006.01) |
| *B63B 7/00* | (2006.01) |
| *B63H 16/20* | (2006.01) |

(52) U.S. Cl.

CPC *B63H 16/14* (2013.01); *B63B 1/12* (2013.01); *B63B 7/04* (2013.01); *B63B 2007/003* (2013.01); *B63H 2016/202* (2013.01)

(58) Field of Classification Search

CPC ..... B63H 16/14; B63B 35/36
USPC ..... 440/27
See application file for complete search history.

(56) References Cited

U.S. PATENT DOCUMENTS

| | | | | | |
|---|---|---|---|---|---|
| 4,744,776 | A * | 5/1988 | Morrison | 440/29 |
| 4,968,274 | A * | 11/1990 | Gregory | 440/27 |
| 5,011,441 | A * | 4/1991 | Foley et al. | 440/30 |
| 5,374,206 | A * | 12/1994 | Gregory | 440/57 |
| 5,540,604 | A * | 7/1996 | Dayton | 440/27 |
| 5,626,501 | A * | 5/1997 | He | 440/30 |
| 5,651,706 | A * | 7/1997 | Kasper | 440/29 |
| 5,702,274 | A * | 12/1997 | White | 440/21 |
| 5,718,611 | A * | 2/1998 | Schlangen et al. | 440/27 |
| 5,860,378 | A * | 1/1999 | Schaller | 114/39.11 |
| 5,878,682 | A * | 3/1999 | Hulbig et al. | 114/61.2 |
| 5,921,824 | A * | 7/1999 | Ilagan | 440/26 |
| 6,065,414 | A * | 5/2000 | Hulbig et al. | 114/56.1 |
| 6,267,631 | B1 * | 7/2001 | Anderson | 440/12 |
| 6,691,633 | B1 * | 2/2004 | Metzger et al. | 114/61.1 |
| 6,855,016 | B1 * | 2/2005 | Jansen | 440/6 |
| 7,037,149 | B1 * | 5/2006 | Mauzy | 440/27 |
| 8,986,057 | B2 * | 3/2015 | Catarina | 440/21 |
| D727,241 | S * | 4/2015 | Schiller et al. | D12/306 |
| 2014/0370767 | A1 * | 12/2014 | Kachkovsky | 440/27 |

* cited by examiner

*Primary Examiner* — Lars A Olson
*Assistant Examiner* — Jovon Hayes

(57) ABSTRACT

A portable, human-powered, catamaran styled water cycle that can be used by users of all ages. The water cycle contains a left pontoon, a right pontoon, a steering mechanism, a propelling mechanism, a seat, a left wheel, and a right wheel. The steering mechanism has a rudder which is controlled with the use of a steering handle. The propelling mechanism has a propeller which is powered by pedaling. The left pontoon and the right pontoon are both foldable such that the water cycle can be extended or collapsed conveniently. The seat is cushioned and also includes a back rest which can be used as a second seat when required. The left wheel is mounted onto the left pontoon and the right wheel is mounted onto the right pontoon. Therefore, the water cycle can be dragged with the use of the wheels for storing purposes.

13 Claims, 16 Drawing Sheets

PORTABLE WATER CYCLE

The current application claims a priority to the U.S. Provisional Patent application Ser. No. 61/835,991 filed on Jun. 17, 2013.

FIELD OF THE INVENTION

The present invention relates generally to the field of water cycles. More specifically, the present invention is a portable, human-powered, catamaran styled, recreational watercraft.

BACKGROUND OF THE INVENTION

Watercrafts and boats have been traditionally used to transport goods and people across water. However, with developments in technology watercrafts and boats have been used for recreational activities and sports. Rowing, rafting, kayaking, and canoeing are among some of the recreational activities that take place at a competitive level.

In contrast to participating in water related activities at a competitive level, many individuals also prefer to be involved in water related activities as a recreational activity. Jet skis are one such watercraft that is intended for recreational activities. However, jet skis cannot be used by individuals of all ages. As an example, an elderly person or a child may not be able to handle a jet ski. Among other similar watercrafts such as canoes and kayaks, water cycles can be noted as a watercraft that can be used by individuals of all ages.

Water cycles are mostly used during warm weather conditions. Children and adults are equally likely to enjoy riding water cycles during family outings and other activities such as fishing. Almost all water cycles we see today are fixed in size and require special transportation methods. As a result, most of the water cycle owners are individuals who live close to an area where the water cycle can be used or have special means for transporting the water cycle. On the other hand, renting water cycles have evolved into a very profitable business. Most individuals or groups rent water cycles investing notable amounts. Even if renting a water cycle is a possibility, a water cycle may not be always available at a user's preference. For instance, water cycle renting personnel may not be able to provide for the increasing number of water cycle users. Also, water cycle rental outlets may not be available at a desired location.

Another issue is that existing water cycles are difficult to transport. With the existing fixed designs, the water cycles need to be either carried or dragged across land prior to being used on water. As a result, components that make contact with ground can be damaged over time. Furthermore, all existing water cycles require assembly and disassembly before each use. The process of assembling and disassembling repeatedly can be time consuming and also stressful to a user.

The objective of the present invention is to address the aforementioned issues. In particular, the present invention is a portable water cycle that can be transported and utilized with great convenience. Additionally, the present invention includes features that allow users of different build and height to utilize the present invention.

DETAIL DESCRIPTIONS OF THE INVENTION

Figure 1:
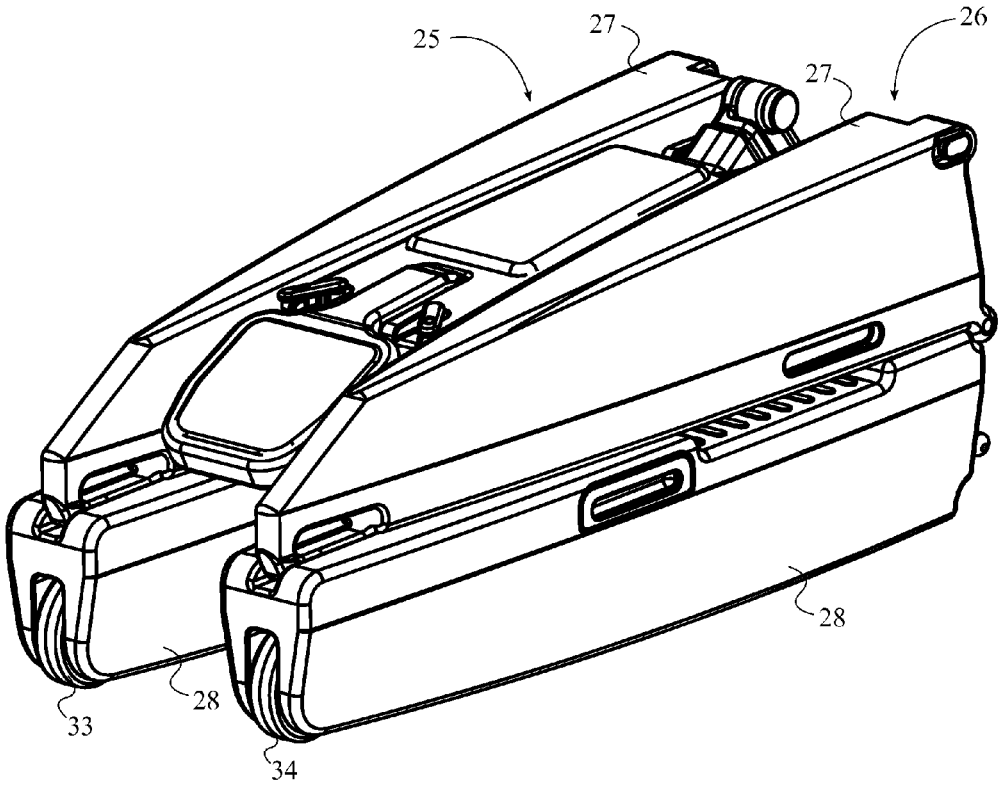
FIG. 1 is a perspective view of the present invention in its collapsed configuration.

All illustrations of the drawings are for the purpose of describing selected versions of the present invention and are not intended to limit the scope of the present invention.

As seen in FIG. 1-13, the present invention is a portable, human-powered, catamaran styled watercraft. In particular, the present invention has a collapsed configuration for easy transportation and also a functional configuration which allows the present invention to be used as a water cycle.

The present invention comprises a propelling mechanism 1, a steering mechanism 30, a plurality of left legs 18, a plurality of right legs 20, a seat 22, a left pontoon 25, and a right pontoon 26. The propelling mechanism 1 is utilized to guide the present invention in a forward or backwards direction. The steering mechanism 30 is utilized along with the propelling mechanism 1 in order to change the direction. More specifically, the propelling mechanism 1 can be used along with the steering mechanism 30 such that the direction the present invention travels can be changed while the present invention is moving forward or backwards. The left pontoon 25 and the right pontoon 26 are utilized to keep the present invention afloat on water. The plurality of left legs 18 and the plurality of right legs 20 elevate the seat 22 from the left pontoon 25 and the right pontoon 26 providing a comfortable seating surface for the user.

Figure 2:
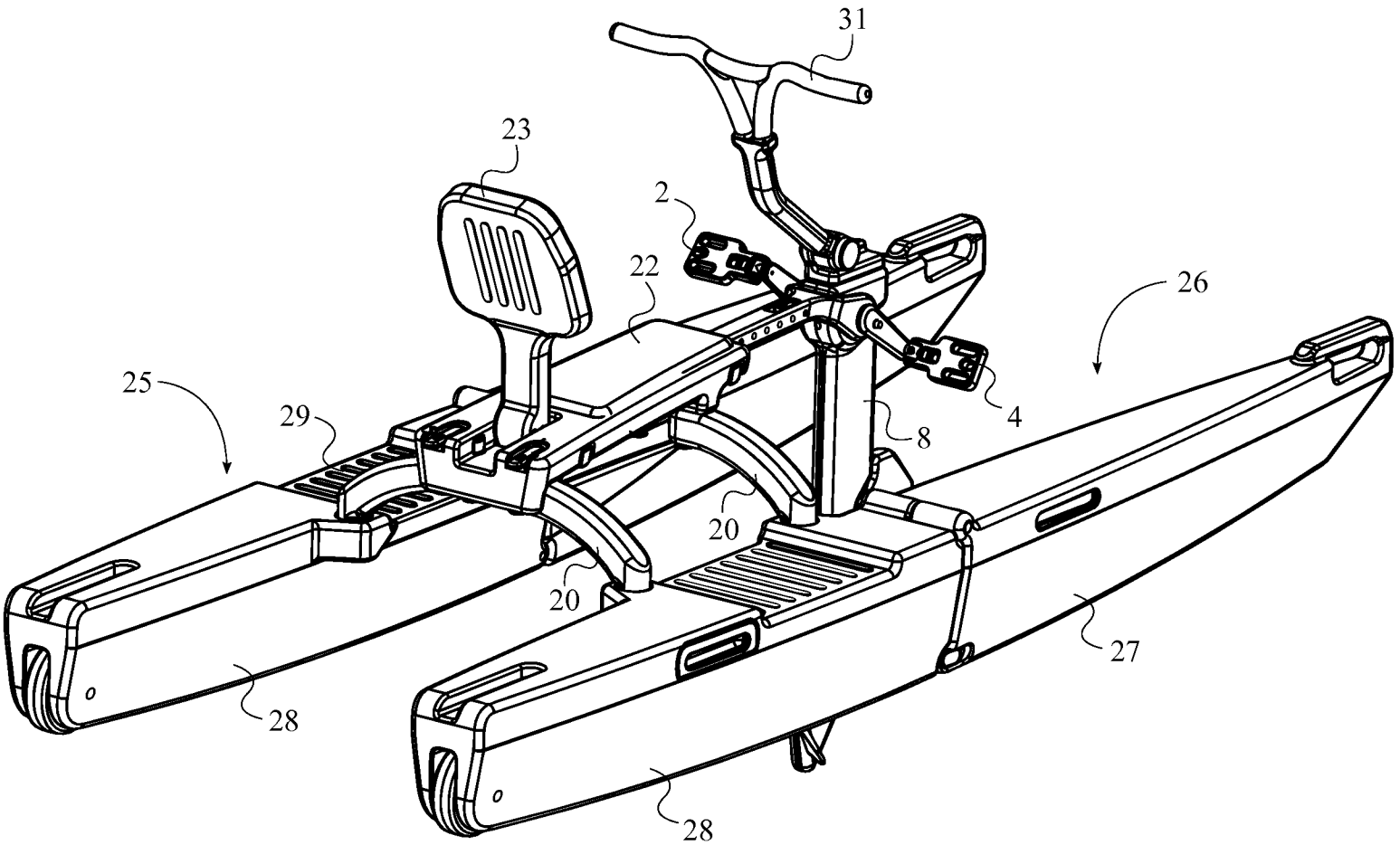
FIG. 2 is a perspective view of the present invention in its functional configuration.
Figure 11:
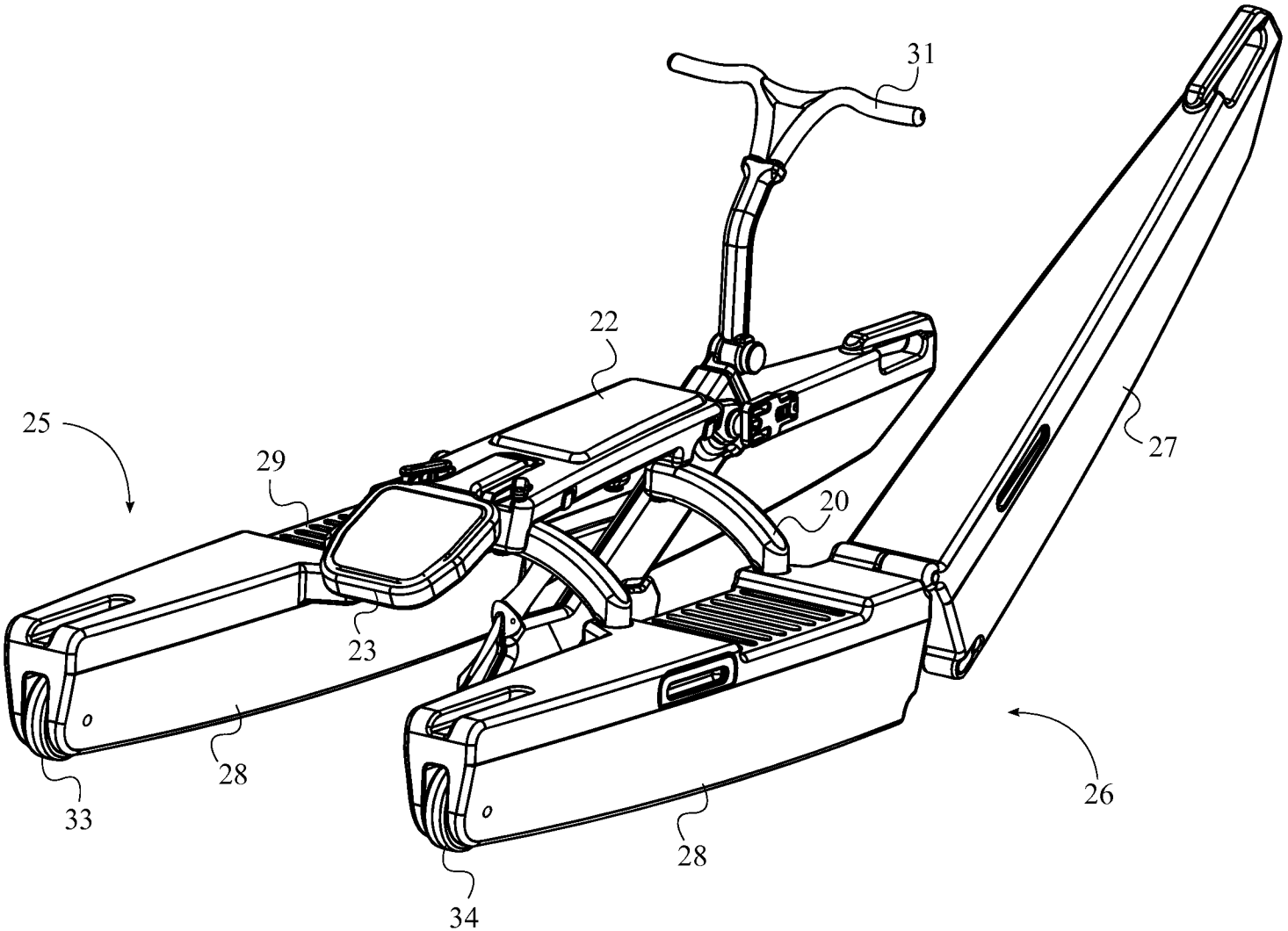
FIG. 11 is a perspective view of the present invention in its partially collapsed configuration.
Figure 12:
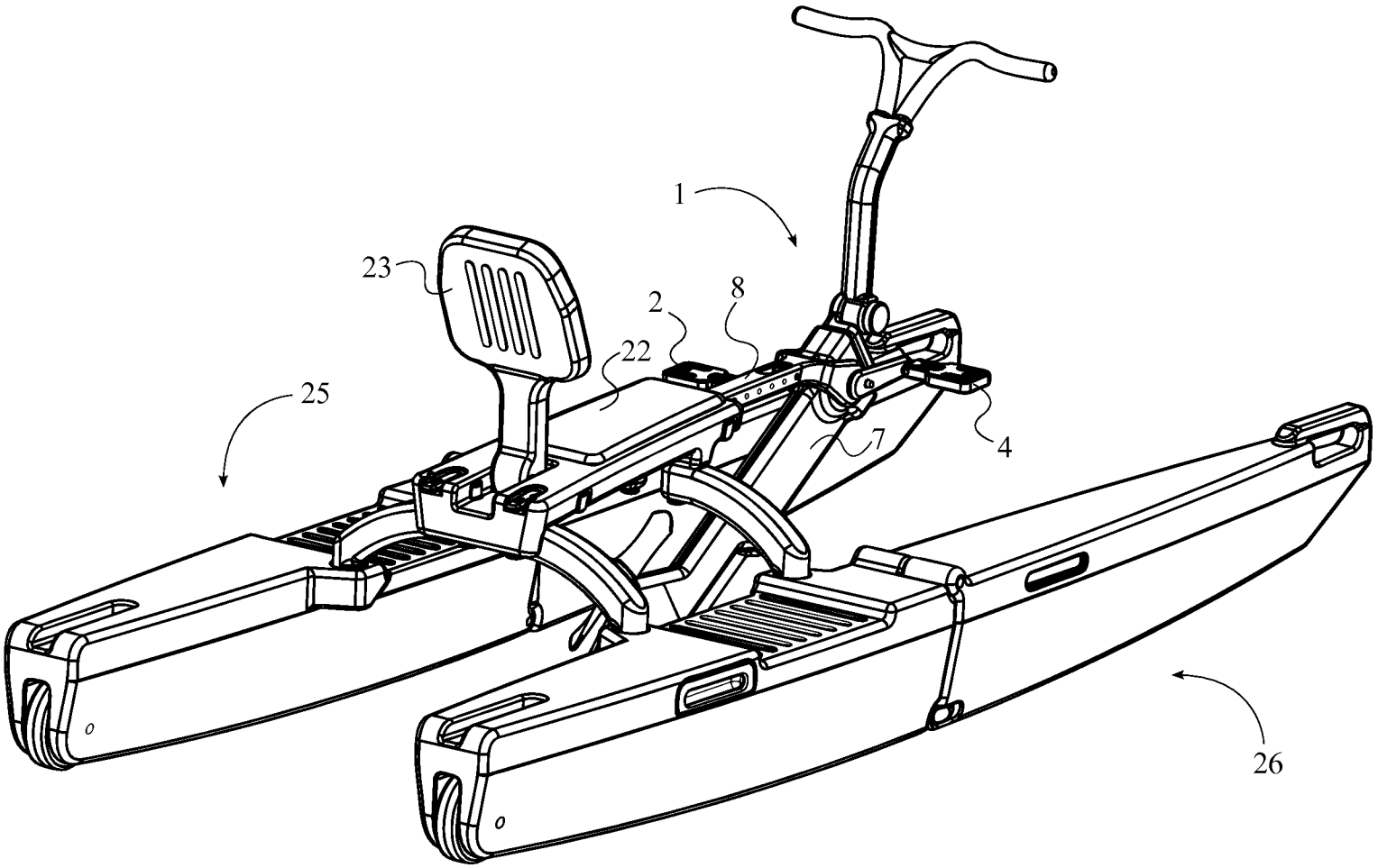
FIG. 12 is a perspective view of the present invention in its fully functional configuration, wherein the steering mechanism is in its second rotational direction.

The functional configuration of the present invention is illustrated in FIG. 2. The left pontoon 25 and the right pontoon 26 each comprise a front section 27 and a rear section 28. As seen in FIG. 11, the front section 27 of the right pontoon 26 is hingedly connected to the rear section 28 of the right pontoon 26. Similarly, the front section 27 of the left pontoon 25 is hingedly connected to the rear section 28 of the left pontoon 25. In this configuration, the front section 27 of the left pontoon 25 is collinearly positioned with the rear section 28 of the left pontoon 25. The front section 27 of the left pontoon 25 is locked collinearly with the rear section 28 of the left pontoon 25 with a spring loaded lock. The spring loaded lock is pivotally coincident with the hinged connection of the front section 27 of the left pontoon 25 and the rear section 28 of the left pontoon 25. Likewise, the front section 27 of the right pontoon 26 is collinearly positioned with rear section 28 of the right pontoon 26 which allows the present invention to stay afloat on water. The front section 27 of the right pontoon 26 is collinearly positioned with the rear section 28 of the right pontoon 26 with another spring loaded lock. The spring loaded lock is pivotally coincident with the hinged connection of the front section 27 of the right pontoon 26 and the rear section 28 of the right pontoon 26. In the present invention, the plurality of left legs 18 is pivotally connected between the seat 22 and the rear section 28 of the left pontoon 25 such that the distance between the rear section 28 and the seat 22 is interchangeable. Similarly, the plurality of right legs 20 is pivotally connected between the seat 22 and the rear section 28 of the right pontoon 26. In the functional configuration, the plurality of left legs 18 is perpendicularly positioned to the seat 22 such that the distance between the seat 22 and the left pontoon 25 is at a maximum. Likewise, the plurality of right legs 20 is also perpendicularly positioned to the seat 22 resulting in maximum distance between the seat 22 and the right pontoon 26. In order to secure the plurality of left legs 18 and the plurality of right legs 20 in the functional configuration, the present invention is equipped with leg locks.

Figure 13:
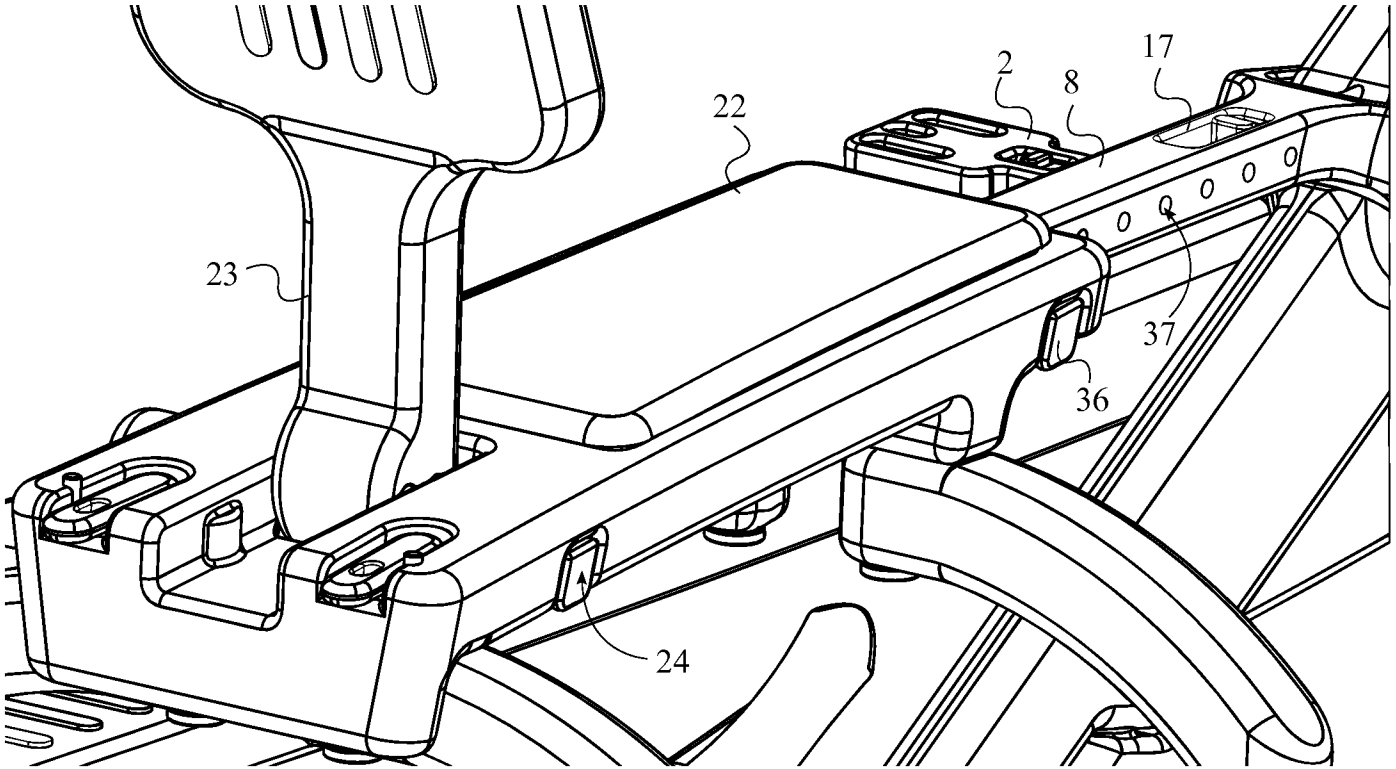
FIG. 13 is a perspective view of the present invention in its functional configuration, wherein the seat is illustrated.

A user operates the present invention while being seated on the seat 22. The present invention further comprises a back rest 23 and a back rest lock 24. Furthermore, the back rest 23 is hingedly connected to the seat 22. As seen in FIG. 13, the back rest lock 24 is mechanically integrated to the hinged connection between the back rest 23 and the seat 22, which allows the user to secure the back rest 23 in multiple positions. In the functional configuration, the back rest 23 can also be used as a second seat 22. The seat further comprises an extended surface that prevents the plurality of left legs 18 and the plurality of right legs 20 from extending beyond a 90-degree angle in the functional configuration. In order to provide comfortable seating, the seat 22 and the back rest 23 are equipped with cushions.

Figure 6:
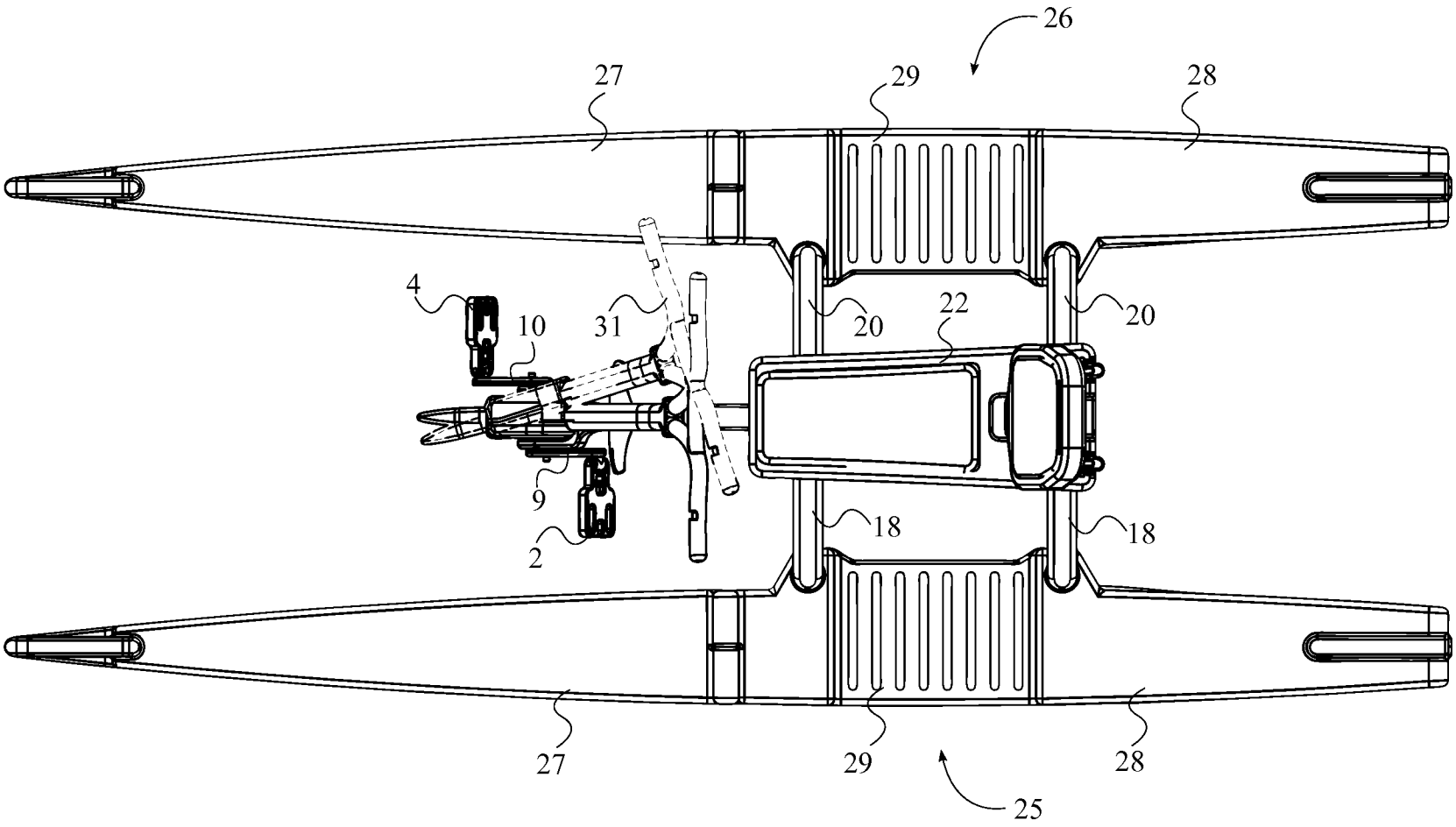
FIG. 6 is a top view of the present invention in its functional configuration, wherein the first rotational direction of the steering mechanism is illustrated.

A user mounts or dismounts the present invention by stepping on either the rear section 28 of the left pontoon 25 or the rear section 28 of the right pontoon 26. Since the present invention is used in wet conditions, the left pontoon 25 and the right pontoon 26 have a high probability of being wet during mounting and dismounting. To avoid slipping, the present invention comprises a plurality of slip resistant platforms 29 as seen in FIG. 6. The plurality of slip resistant platforms 29 is positioned atop the rear section 28 of both the left pontoon 25 and the right pontoon 26.

Figure 5:
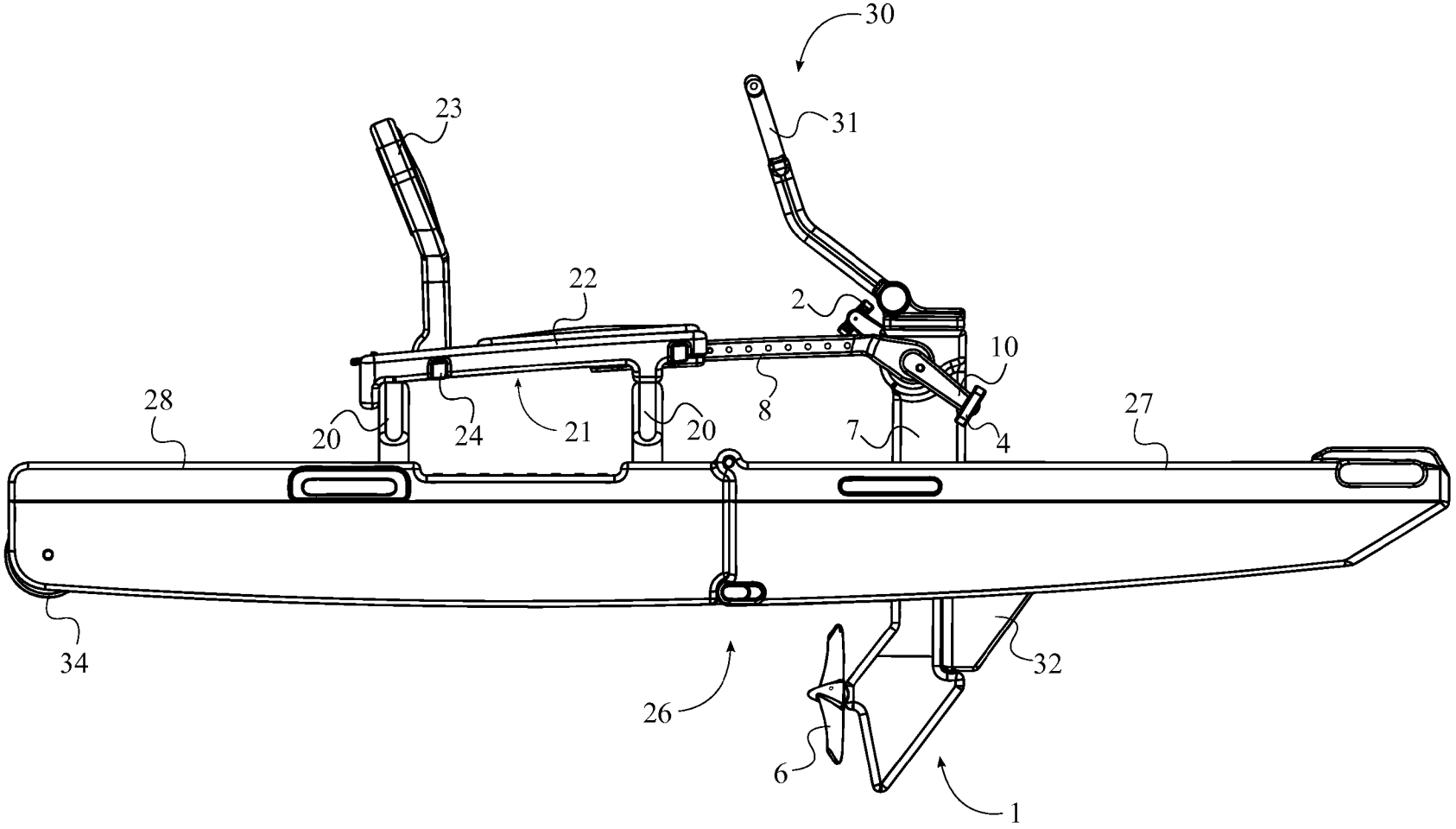
FIG. 5 is a right side view of the present invention in its functional configuration.
Figure 14:
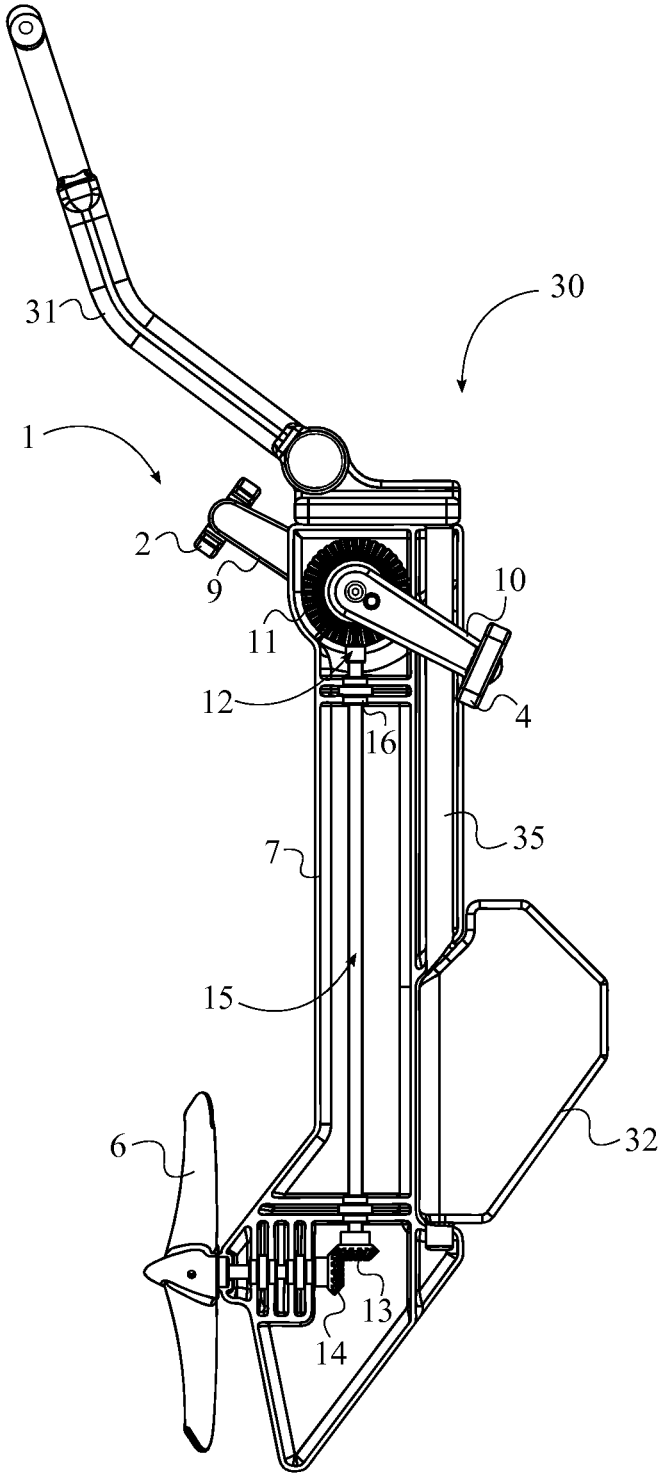
FIG. 14 is a cross-sectional right side view of the present invention, wherein the propelling mechanism and the steering mechanism is illustrated.
Figure 15:
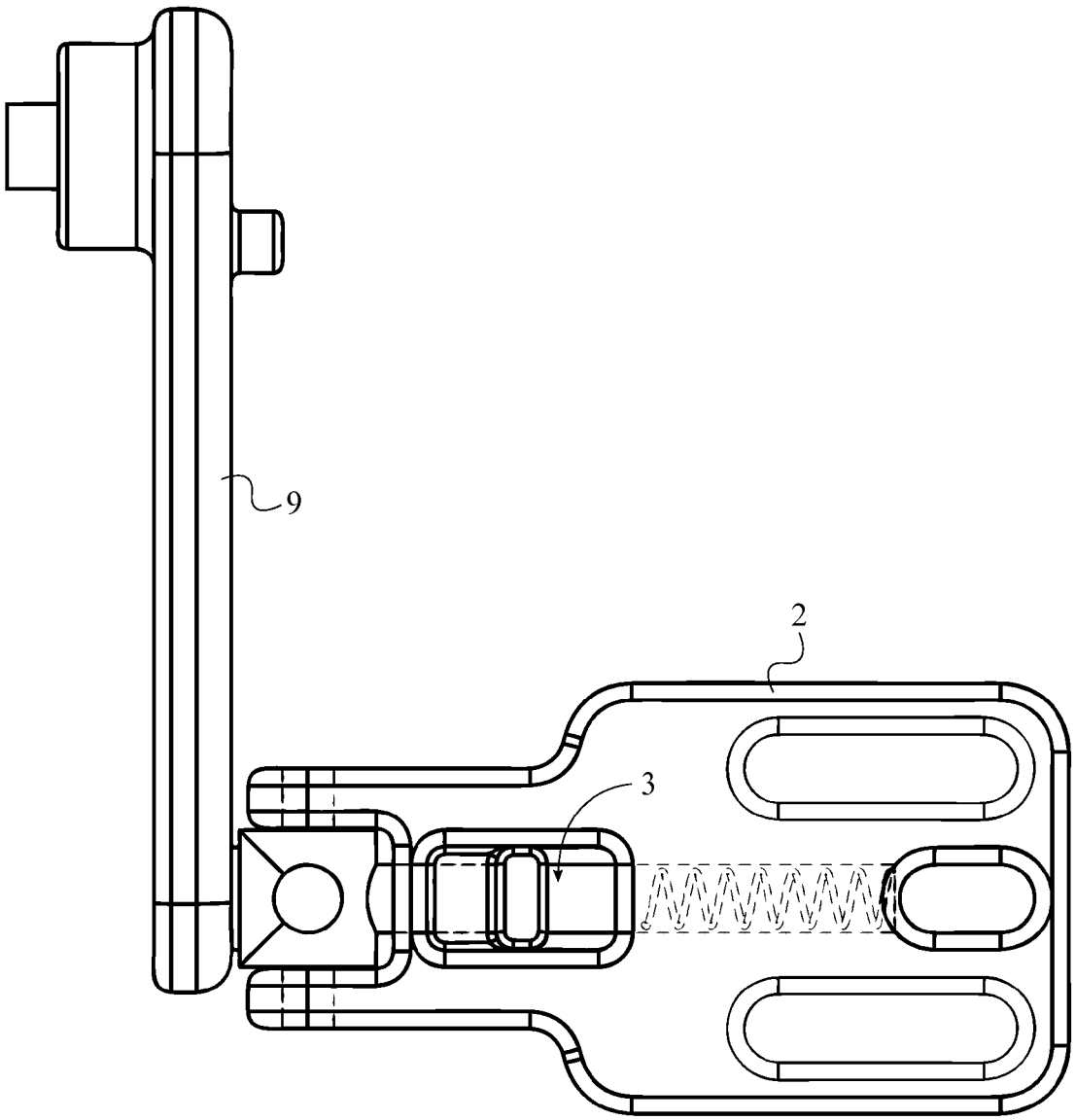
FIG. 15 is a front side view of the left pedal, wherein the left pedal is in its functional configuration.

As mentioned earlier, the forward or backwards direction of the present invention is determined by the propelling mechanism 1. The propelling mechanism 1 comprises a left pedal 2, a right pedal 4, a drive housing 7, and a propeller 6. The left pedal 2 and the right pedal 4 are operatively coupled to the propeller 6 such that the propeller 6 is mechanically driven by the left pedal 2 and the right pedal 4. As illustrated in FIG. 5 and FIG. 14, the propelling mechanism 1 further comprises a length-adjustable extension arm 8, a left pedal crank 9, a right pedal crank 10, a proximal bevel gear 11, a first bevel gear 12, a second bevel gear 13, a distal bevel gear 14, a vertical shaft 15, and a bearing 16. In the functional configuration the left pedal 2 is perpendicularly positioned to the left pedal crank 9 with a left pedal spring lock 3 as seen in FIG. 15. Similarly, the right pedal 4 is perpendicularly positioned to the right pedal crank 10 with a right pedal spring lock 5 in the functional configuration. The length-adjustable extension arm 8 is positioned in between the left pedal crank 9 and the right pedal crank 10. Therefore, users of different heights can utilize the present invention by alternating the length-adjustable extension arm 8. In order to lock the length-adjustable extension arm 8, the present invention is equipped with an extension arm lock 36 and a plurality of extension arm holes 37. The extension arm lock 36 engages with the plurality of extension arm holes 37 to provide a desired length of the length-adjustable extension arm 8. Furthermore, the left pedal crank 9 and the right pedal crank 10 are rotatably mounted onto the length-adjustable arm such that the left pedal 2 and the right pedal 4 extend outwards allowing easy pedaling access to the user. In order to control the propeller 6 through the left pedal 2 and the right pedal 4, the left pedal crank 9 and the right pedal crank 10 are axially connected to the proximal bevel gear 11. In the process of transferring force from the left pedal 2 and the right pedal 4 to the propeller 6, the proximal bevel gear 11 is perpendicularly engaged to the first bevel gear 12. Furthermore, the first bevel gear 12 and the second bevel gear 13 are positioned opposite to each other along the vertical shaft 15 and also axially connected to the vertical shaft 15. Furthermore, the vertical shaft 15 is rotatably mounted within the drive housing 7 with the use of the bearing 16. The drive housing 7 is hingedly connected to the length-adjustable extension arm 8. The hinged connection between the drive housing 7 and the length-adjustable extension arm 8 is mechanically integrated with a pivot drive lock 17. The second bevel gear 13 is perpendicularly engaged to the distal bevel gear 14 such that the rotational force from the left pedal 2 and the right pedal 4 is transferred through the vertical shaft and into the distal bevel gear 14. The propeller 6 is axially connected to the distal bevel gear 14, which allows the propeller 6 to rotate according to the user's input force at the left pedal 2 and the right pedal 4.

Figure 7:
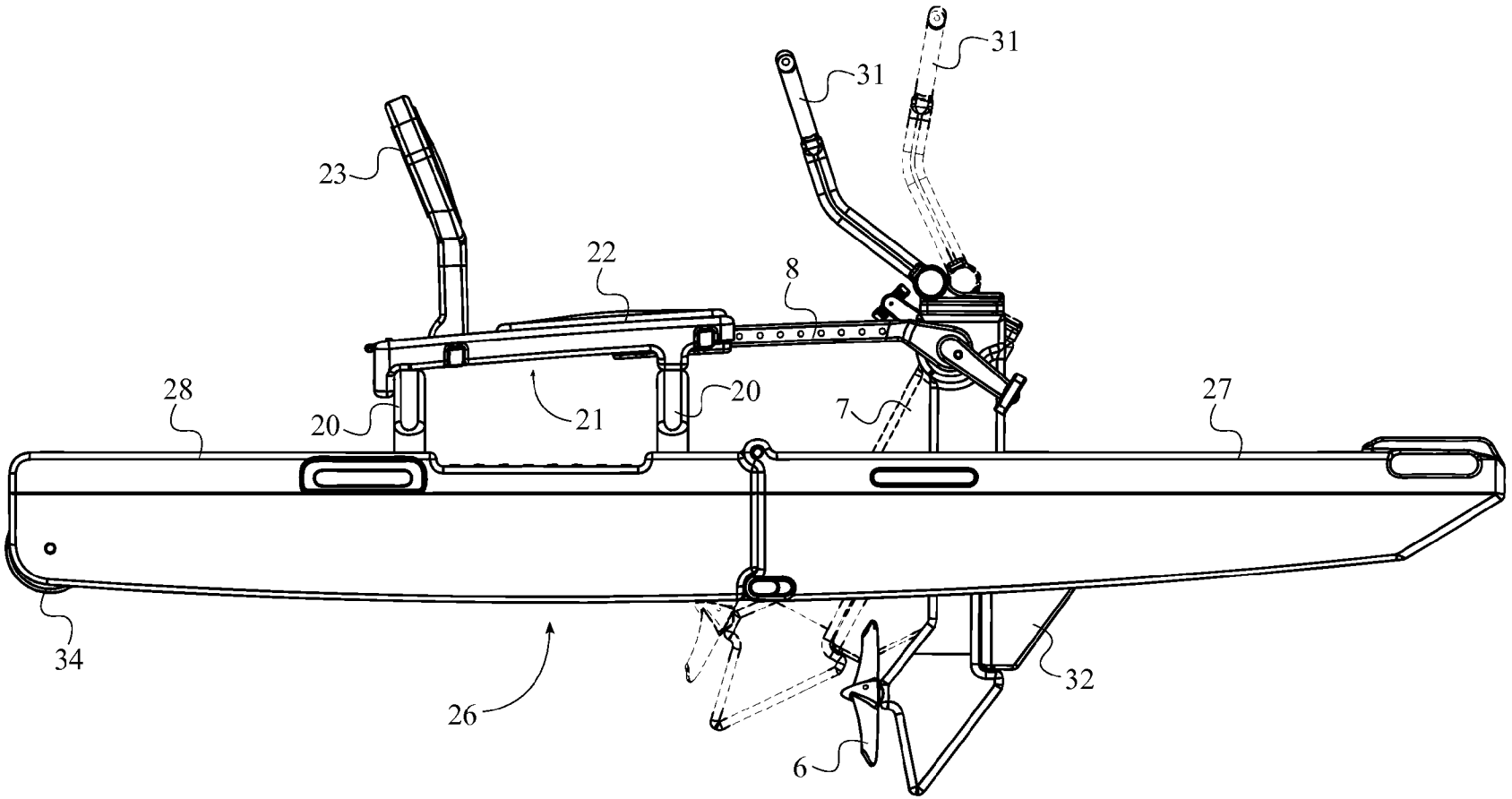
FIG. 7 is a right side view of the present invention in its functional configuration, wherein the second rotational direction of the steering mechanism is illustrated.

The angular direction of the present invention travels is determined by the steering mechanism 30. The steering mechanism 30 has two embodiments. In its first embodiment, the steering mechanism 30 comprises a steering handle 31, a rudder shaft 35, and a rudder 32, where they are pivotally connected to the length-adjustable extension arm 8. As illustrated in FIG. 14, the steering handle 31 is operatively coupled to the rudder 32 by the rudder shaft 35, which allows the steering handle 31 to mechanically orient the rudder 32 through the rudder shaft 35. The rudder 32 is hingedly connected to the drive housing 7 and is also positioned in parallel to the vertical shaft 15 and the rudder shaft 35. The propelling mechanism 1 is positioned in between the left pontoon 25 and the right pontoon 26. The rudder shaft 35 is positioned within the drive housing 7. As a result, the steering mechanism 30 is also positioned between the left pontoon 25 and the right pontoon 26. As illustrated in FIG. 6, the connected steering mechanism 30 and the propelling mechanism 1 can be rotated along leftward and rightward direction by utilizing the pivot drive lock 17. As seen in FIG. 7, the connected steering mechanism 30 and the propelling mechanism 1 can also be moved in a forward or backward direction with the use of the pivot drive lock 17.

The second embodiment of the steering mechanism comprises a steering handle, a steering guide, a guiding bar, a drive guide track, a rudder crank, and a rudder. The seat of the present invention further comprises a bottom surface, wherein the bottom surface is opposite to the seating surface.

The drive guide track traverses the bottom surface of the seat. The steering guide comprises a first end and a second end and is slidably positioned within the drive guide track. The steering handle is perpendicularly connected to the steering guide at the first end. The rudder is pivotally connected to the rudder crank. Furthermore, the rudder crank is perpendicularly connected to the steering guide at the second end opposite to the steering handle. As a result of the connection, sliding the steering handle changes the orientation of the rudder. The steering handle and the steering guide assembly is in between the bottom surface and the guiding bar such that the steering handle and steering guide assembly remains stationary within the drive guide track.

Figure 3:
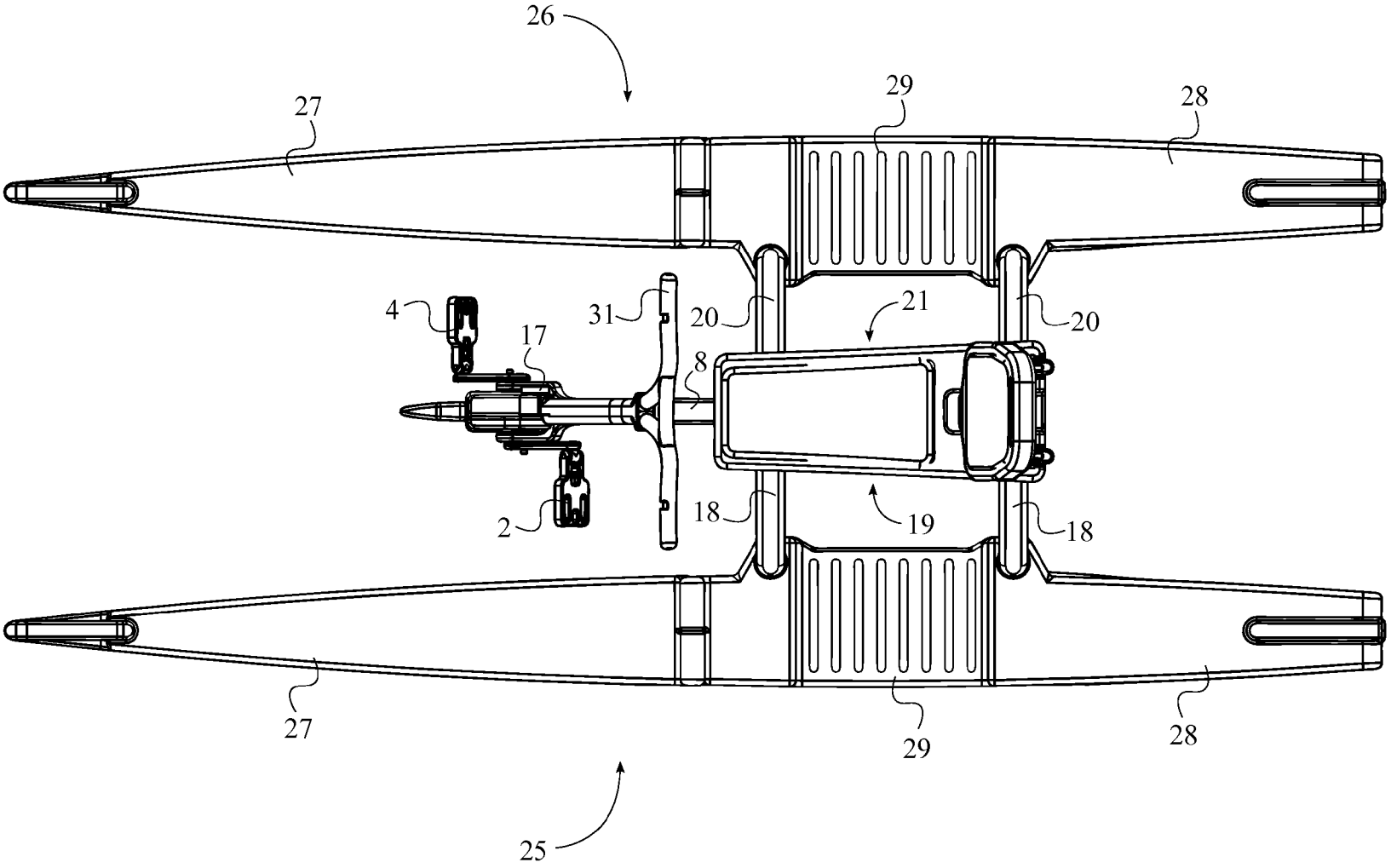
FIG. 3 is a top view of the present invention in its functional configuration.
Figure 4:
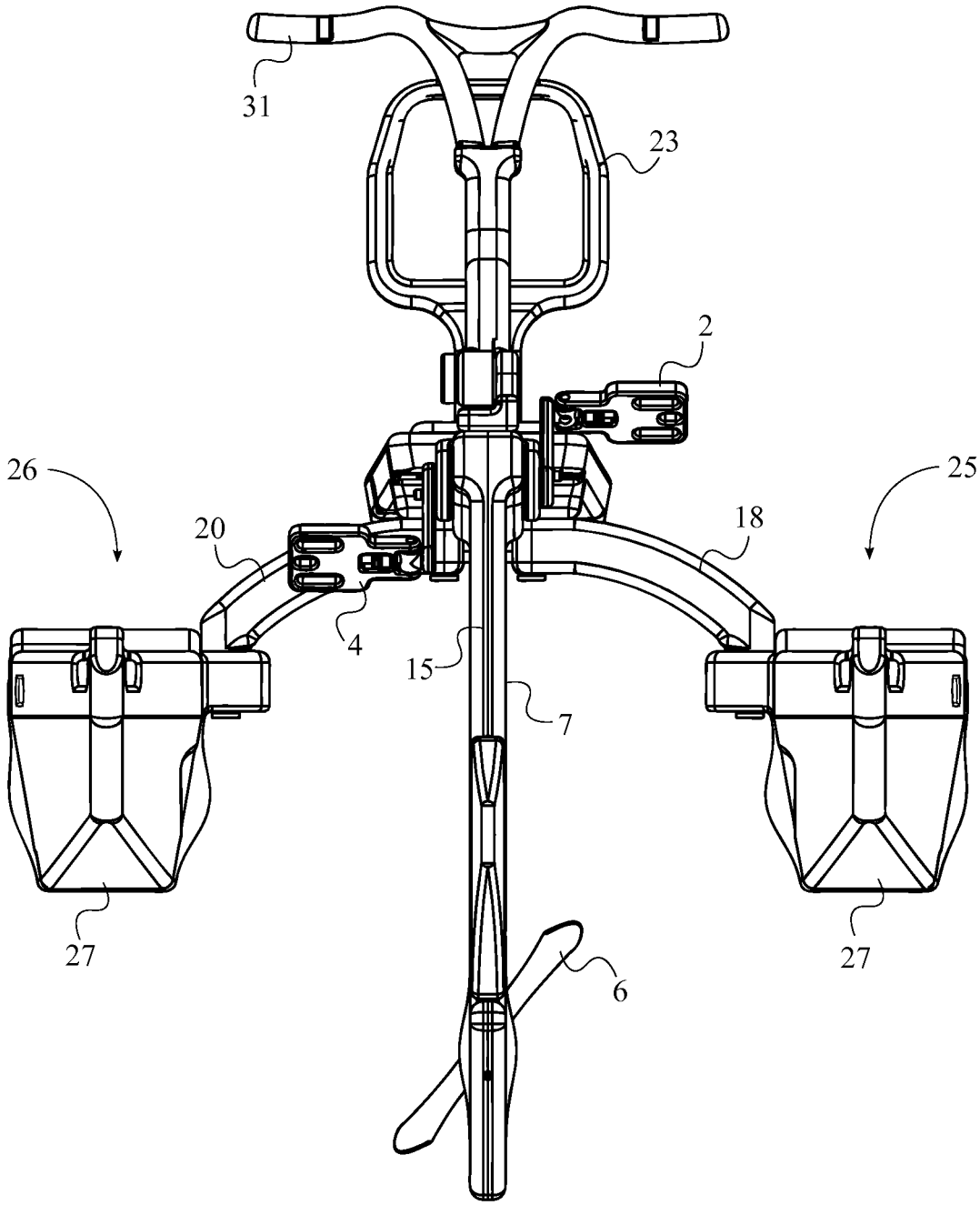
FIG. 4 is a front view of the present invention in its functional configuration.
Figure 9:
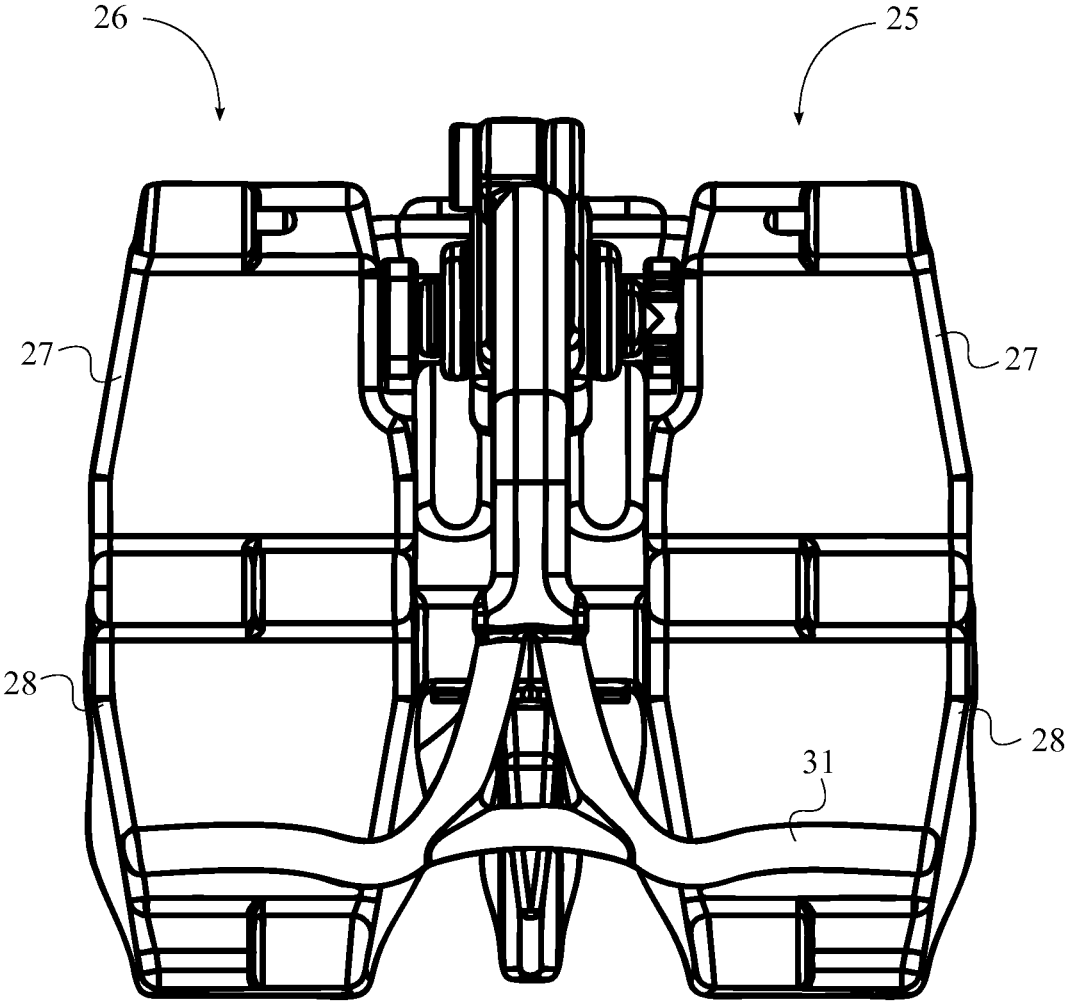
FIG. 9 is a front view of the present invention in its collapsed configuration, wherein the steering handle is in a locked position.
Figure 10:
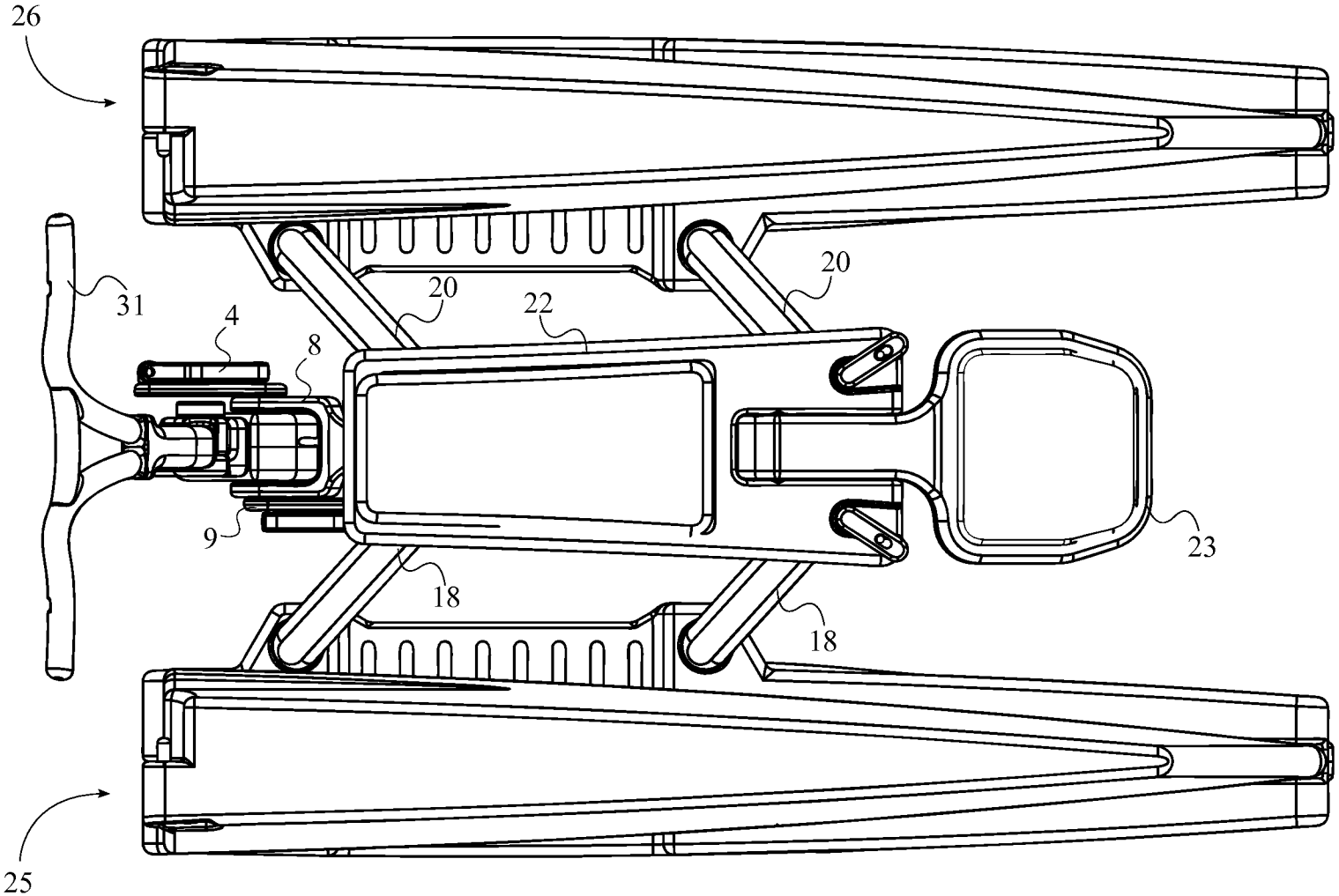
FIG. 10 is a top view of the present invention in its partially collapsed configuration.
Figure 16:
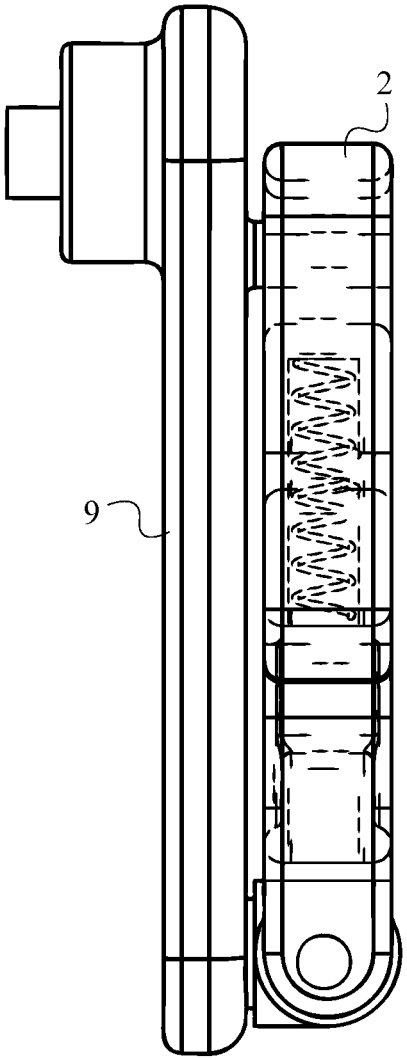
FIG. 16 is a front side view of the left pedal, wherein the left pedal is in its collapsed configuration.

The collapsed and portable configuration of the present invention is illustrated in FIG. 1. In this configuration, the left pontoon 25, the plurality of left legs 18, the right pontoon 26, the plurality of right legs 20, the left pedal 2, and the right pedal 4 are positioned into the collapsed configuration. For the plurality of left legs 18 and the plurality of right legs 20 to be in the collapsed configuration, the present invention further comprises a plurality of left leg receiving holes 19 and a plurality of right leg receiving holes 21 as seen in FIG. 3. Moreover, the plurality of left leg receiving holes 19 is positioned adjacent to the plurality of left legs 18, such that the plurality of left legs 18 can collapse into the plurality of left leg receiving holes 19. Likewise, the plurality of right leg receiving holes 21 is positioned adjacent to the plurality of right legs 20, which allows the plurality of right legs 20 to collapse within the plurality of right leg receiving holes 21. As seen in FIG. 9, the plurality of left legs 18 and the plurality of right legs 20 are secured in place when the steering handle 31 is in its collapsed configuration. In order to lock the steering handle 31 in the collapsed configuration the present invention is equipped with a steering handle lock. The collapsed configuration of the plurality of left legs 18 reduces the distance between the seat 22 and the left pontoon 25 to a minimum. Similarly, the collapsed configuration of the plurality of right legs 20 reduces the distance between the seat 22 and the right pontoon 26 to a minimum. The hinged connection on both the left pontoon 25 and the right pontoon 26 allows the present invention to further reduce in size. More specifically, in the collapsed configuration, the front section 27 of the left pontoon 25 is positioned atop of the rear section 28 of the left pontoon 25. Also, the front section 27 of the right pontoon 26 is positioned atop of the rear section 28 of the right pontoon 26 as shown in FIG. 9. Additionally, the left pedal 2 and the right pedal 4 can also have a collapsed configuration as seen in FIG. 16. In particular, the left pedal 2 is positioned adjacent to the left pedal crank 9 with the use of the left pedal spring lock 3. The right pedal 4 is placed adjacent to the right pedal crank 10 with the use of the right pedal spring lock 5.

Figure 8:
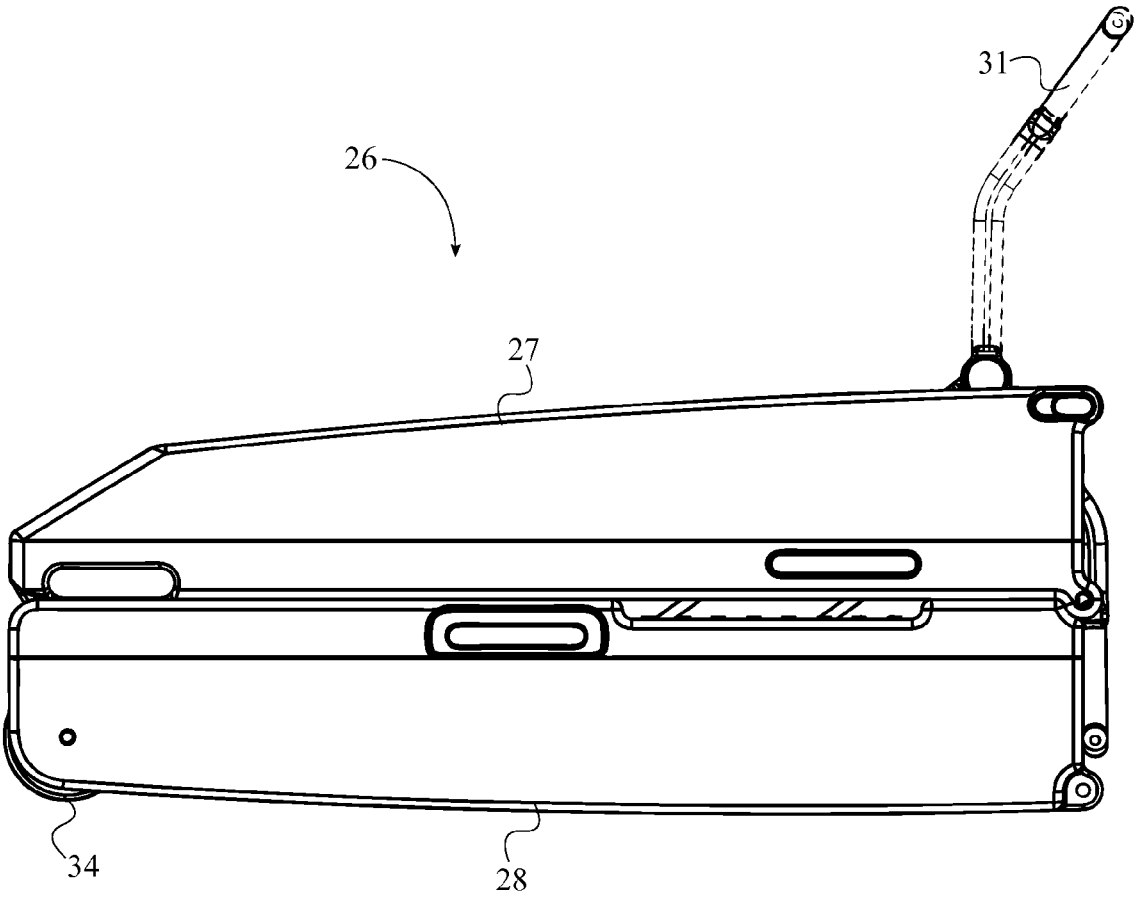
FIG. 8 is a right side view of the present invention in its collapsed configuration, wherein the steering handle is in an unlocked position.

Another advantage of the present invention is the ability to be dragged in its collapsed configuration. In order to implement this feature, the present invention comprises a left wheel 33 and a right wheel 34. As seen in FIG. 11, the left wheel 33 is rotatably mounted into the rear section 28 of the left pontoon 25. As a result, the left wheel 33 is positioned opposite the steering handle 31 and also opposite the front section 27 of the left pontoon 25. The right wheel 34 is rotatably mounted into the rear section 28 of the right pontoon 26. Similar to the left wheel 33, the right wheel 34 is positioned opposite the steering handle 31 and also opposite the front section 27 of the right pontoon 26. As seen in FIG. 8, the pivotal connection of the steering handle 31 allows the steering handle 31 to be used in both the functional configuration and also the collapsed configuration of the present invention. As a result, the steering handle 31 can be used to drag the present invention in its collapsed configuration. When storing the present invention, the steering handle 31 is collapsed as seen in FIG. 9.

In extending the present invention from its collapsed configuration the consequent process flow is followed. As seen in FIG. 8, the steering handle 31 is initially lifted to its functional configuration by unlocking the steering handle lock. Lifting the steering handle 31 to its functional configuration allows the present invention to be extended further. Next, both the left pontoon 25 and the right pontoon 26 are pulled outwards to its functional configuration. In order to assist in handling, the present invention is equipped with a first plurality of handgrips on the rear section 28 of both the left pontoon 25 and the right pontoon 26. As a result of pulling outwards, the plurality of left legs 18 and the plurality of right legs 20 will be positioned perpendicular to the seat 22. The extended surface of the seat ensures that the plurality of left legs 18 and the plurality of right legs 20 do not exceed a 90-degree angle. When complete, the front section 27 of both the left pontoon 25 and the right pontoon 26 can be extended about the hinged connection. The present invention is equipped with a second plurality of handgrips in order to assist in extending the front section 27 of both the left pontoon 25 and also the right pontoon 26. The second plurality of handgrips is positioned on the front section 27 of the left pontoon 25 and the front section 27 of the right pontoon 26. The spring loaded lock of the left pontoon 25 positions the front section 27 collinear to the rear section 28. The spring loaded lock of the right pontoon 26 positions the front section 27 collinear to the rear section 28.

Although the invention has been explained in relation to its preferred embodiment, it is to be understood that many other possible modifications and variations can be made without departing from the spirit and scope of the invention as hereinafter claimed.

What is claimed is:

1. A portable, human-powered water cycle comprises:

a propelling mechanism;

a plurality of left legs;

a plurality of right legs;

a steering mechanism;

a seat;

a left pontoon;

a right pontoon;

the propelling mechanism comprises a left pedal, a right pedal, a drive housing, and a propeller;

the steering mechanism comprises a steering handle, a rudder shaft, and a rudder;

the left pontoon and the right pontoon each comprise a front section and a rear section;

the propelling mechanism, the steering mechanism, and the seat being positioned in between the left pontoon and the right pontoon;

the front section of the left pontoon being hingedly connected to the rear section of the left pontoon;

the front section of the right pontoon being hingedly connected to the rear section of the right pontoon;

the left pedal and the right pedal being operatively coupled to the propeller, wherein the left pedal and the right pedal mechanically drive the propeller;

the plurality of left legs being pivotally connected between the seat and the rear section of the left pontoon;

the plurality of right legs being pivotally connected between the seat and the rear section of the right pontoon;

the steering handle being operatively coupled to the rudder by the rudder shaft, wherein the steering handle mechanically orients the rudder through the rudder shaft;

the rudder shaft being positioned within the drive housing;

the rudder being hingedly connected to the drive housing;

the rudder being positioned parallel to a vertical shaft of the propelling mechanism and the rudder shaft; and the rudder shaft being operatively engaged with the rudder.

2. The portable, human-powered water cycle as claimed in claim 1 comprises:

the propelling mechanism further comprises a length-adjustable extension arm, a left pedal crank, a right pedal crank, a proximal bevel gear, a first bevel gear, a second bevel gear, a distal bevel gear, a vertical shaft, and a bearing;

the length-adjustable extension arm being positioned in between the left pedal crank and the right pedal crank;

the left pedal crank and the right pedal crank being rotatably mounted onto the length-adjustable extension arm;

the proximal bevel gear being axially connected to both the left pedal crank and the right pedal crank;

the first bevel gear and the second bevel gear being positioned opposite to each other along the vertical shaft;

the first bevel gear and the second bevel gear being axially connected to the vertical shaft;

the vertical shaft being rotatably mounted within the drive housing by the bearing;

the propeller being axially connected to the distal bevel gear;

the first bevel gear being perpendicularly engaged to the proximal bevel gear;

the second bevel gear being perpendicularly engaged to the distal bevel gear; and the steering mechanism being pivotally connected to the length-adjustable extension arm.

3. The portable, human-powered water cycle as claimed in claim 2 comprises:

a pivot drive lock;

the drive housing being hingedly connected to the length-adjustable extension arm; and the pivot drive lock being mechanically integrated into the hinged connection between the drive housing and the length-adjustable extension arm.

4. The portable, human-powered water cycle as claimed in claim 1 comprises:

a back rest;

a back rest lock;

the back rest being hingedly connected to the seat; and the back rest lock being mechanically integrated into the hinged connection between the back rest and the seat.

5. The portable, human-powered water cycle as claimed in claim 1 comprises:

a plurality of slip resistant platforms; and the plurality of slip resistant platforms being positioned atop the rear section of both the left pontoon and the right pontoon.

6. The portable, human-powered water cycle as claimed in claim 1 comprises:

wherein the left pontoon, the plurality of left legs, the right pontoon, the plurality of right legs, the left pedal, and the right pedal are in a collapsed configuration;

a plurality of left leg receiving holes;

a plurality of right leg receiving holes;

a left pedal spring lock;

a right pedal spring lock;

the front section of the left pontoon being positioned atop the rear section of the left pontoon;

the front section of the right pontoon being positioned atop of the rear section of the right pontoon;

the plurality of left legs being positioned within the plurality of left leg receiving holes;

the plurality of right legs being positioned within the plurality of right leg receiving holes;

the left pedal being positioned adjacent to the left pedal crank by the left pedal spring lock; and the right pedal being positioned adjacent to the right pedal crank by the right pedal spring lock.

7. The portable, human-powered water cycle as claimed in claim 6 comprises:

the plurality of left leg receiving holes being positioned adjacent to the plurality of left legs; and the plurality of right leg receiving holes being positioned adjacent to the plurality of right legs.

8. The portable, human-powered water cycle as claimed in claim 1 comprises:

wherein the left pontoon, the plurality of left legs, the right pontoon, the plurality of right legs, the left pedal, and the right pedal are in an functional configuration;

a left pedal spring lock;

a right pedal spring lock;

the front section of the left pontoon being collinearly positioned with the rear section of the left pontoon;

the front section of the right pontoon being collinearly positioned with the rear section of the right pontoon;

the plurality of left legs being perpendicularly positioned to the seat;

the plurality of right legs being perpendicularly positioned to the seat;

the left pedal being perpendicularly positioned to the left pedal crank by the left pedal spring lock; and the right pedal being perpendicularly positioned to the right pedal crank by the right pedal spring lock.

9. The portable, human-powered water cycle as claimed in claim 6 comprises:

a left wheel;

a right wheel;

the left wheel being rotatably mounted into the rear section of the left pontoon;

the left wheel being positioned opposite the steering handle;

the left wheel being positioned opposite the front section of the left pontoon;

the right wheel being rotatably mounted into the rear section of the right pontoon;

the right wheel being positioned opposite the steering handle; and the right wheel being positioned opposite the front section of the right pontoon.

10. A portable, human-powered water cycle comprises:

a propelling mechanism;

a plurality of left legs;

a plurality of right legs;

a steering mechanism;

a seat;

a left pontoon;

a right pontoon;

the propelling mechanism comprises a left pedal, a right pedal, a drive housing, and a propeller;

the steering mechanism comprises a steering handle, a rudder shaft, and a rudder;

the left pontoon and the right pontoon each comprise a front section and a rear section;

the propelling mechanism, the steering mechanism, and the seat being positioned in between the left pontoon and the right pontoon;

the front section of the left pontoon being hingedly connected to the rear section of the left pontoon;

the front section of the right pontoon being hingedly connected to the rear section of the right pontoon;

the left pedal and the right pedal being operatively coupled to the propeller, wherein the left pedal and the right pedal mechanically drive the propeller;

the plurality of left legs being pivotally connected between the seat and the rear section of the left pontoon;

the plurality of right legs being pivotally connected between the seat and the rear section of the right pontoon;

the steering handle being operatively coupled to the rudder by the rudder shaft, wherein the steering handle mechanically orients the rudder through the rudder shaft;

the propelling mechanism further comprises, a length-adjustable extension arm, a left pedal crank, a right pedal crank, a proximal bevel gear, a first bevel gear, a second bevel gear, a distal bevel gear, a vertical shaft, and a bearing;

the length-adjustable extension arm being positioned in between the left pedal crank and the right pedal crank;

the left pedal crank and the right pedal crank being rotatably mounted onto the length-adjustable extension arm;

the proximal bevel gear being axially connected to both the left pedal crank and the right pedal crank;

the first bevel gear and the second bevel gear being positioned opposite to each other along the vertical shaft;

the first bevel gear and the second bevel gear being axially connected to the vertical shaft;

the vertical shaft being rotatably mounted within the drive housing by the bearing;

the propeller being axially connected to the distal bevel gear;

the first bevel gear being perpendicularly engaged to the proximal bevel gear;

the second bevel gear being perpendicularly engaged to the distal bevel gear; and the steering mechanism being pivotally connected to the length-adjustable extension arm.

11. The portable, human-powered water cycle as claimed in claim 10 comprises:

a pivot drive lock;

a back rest;

a back rest lock;

a plurality of slip resistant platforms;

the drive housing being hingedly connected to the length-adjustable extension arm;

the pivot drive lock being mechanically integrated into the hinged connection between the drive housing and the length-adjustable extension arm;

the rudder shaft being positioned within the drive housing;

the rudder being hingedly connected to the drive housing;

the rudder being positioned parallel to a vertical shaft of the propelling mechanism and the rudder shaft;

the rudder shaft being operatively engaged with the rudder;

the back rest being hingedly connected to the seat;

the back rest lock being mechanically integrated into the hinged connection between the back rest and the seat; and the plurality of slip resistant platforms being positioned atop the rear section of both the left pontoon and the right pontoon.

12. The portable, human-powered water cycle as claimed in claim 10 comprises:

wherein the left pontoon, the plurality of left legs, the right pontoon, the plurality of right legs, the left pedal, and the right pedal are in a collapsed configuration;

a plurality of left leg receiving holes;

a plurality of right leg receiving holes;

a left pedal spring lock;

a right pedal spring lock;

the front section of the left pontoon being positioned atop the rear section of the left pontoon;

the front section of the right pontoon being positioned atop of the rear section of the right pontoon;

the plurality of left legs being positioned within the plurality of left leg receiving holes;

the plurality of right legs being positioned within the plurality of right leg receiving holes;

the left pedal being positioned adjacent to the left pedal crank by the left pedal spring lock;

the right pedal being positioned adjacent to the right pedal crank by the right pedal spring lock;

the plurality of left leg receiving holes being positioned adjacent to the plurality of left legs; and the plurality of right leg receiving holes being positioned adjacent to the plurality of right legs.

13. The portable, human-powered water cycle as claimed in claim 10 comprises:

a left pedal spring lock;

a right pedal spring lock a left wheel;

a right wheel;

wherein the left pontoon, the plurality of left legs, the right pontoon, the plurality of right legs, the left pedal, and the right pedal are in an functional configuration;

the front section of the left pontoon being collinearly positioned with the rear section of the left pontoon;

the front section of the right pontoon being collinearly positioned with the rear section of the right pontoon;

the plurality of left legs being perpendicularly positioned to the seat;

the plurality of right legs being perpendicularly positioned to the seat;

the left pedal being perpendicularly positioned to the left pedal crank by the left pedal spring lock;

the right pedal being perpendicularly positioned to the right pedal crank by the right pedal spring lock;

the left wheel being rotatably mounted into the rear section of the left pontoon;

the left wheel being positioned opposite the steering handle;

the left wheel being positioned opposite the front section of the left pontoon;

the right wheel being rotatably mounted into the rear section of the right pontoon;

the right wheel being positioned opposite the steering handle; and the right wheel being positioned opposite the front section of the right pontoon.

* * * * *